US006607245B1

(12) United States Patent
Scher

(10) Patent No.: US 6,607,245 B1
(45) Date of Patent: Aug. 19, 2003

(54) HEAD RESTRAINT

(76) Inventor: Robert Scher, 3527 Coolheights Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 10/394,052

(22) Filed: Mar. 24, 2003

(51) Int. Cl.[7] ..... A47C 7/38
(52) U.S. Cl. ..... 297/393
(58) Field of Search ..... 297/391, 393, 297/397; 602/17, 36; 128/97.1, 876

(56) References Cited

U.S. PATENT DOCUMENTS

| | | | | | |
|---|---|---|---|---|---|
| 4,182,322 | A | * | 1/1980 | Miller | 5/637 |
| 4,339,151 | A | | 7/1982 | Riggs | 297/464 |
| 4,707,031 | A | | 11/1987 | Meistrell | 297/393 |
| 5,314,404 | A | * | 5/1994 | Boughner et al. | 602/17 |
| 5,395,158 | A | * | 3/1995 | Cordia | 297/393 |
| 6,266,825 | B1 | | 7/2001 | Floyd | 2/338 |
| 6,301,716 | B1 | | 10/2001 | Ross | 2/171 |
| 2002/0067063 | A1 | * | 6/2002 | Taborro | 297/397 |

FOREIGN PATENT DOCUMENTS

| | | | | |
|---|---|---|---|---|
| GB | 2179852 | * | 3/1987 | 297/393 |

* cited by examiner

*Primary Examiner*—Peter R. Brown
(74) *Attorney, Agent, or Firm*—Edgar W. Averill, Jr.

(57) ABSTRACT

A head restraint for supporting a user's head with respect to the head rest portion of a seat. The head restraint has a headband strap for placing over the head across the forehead of the user. An anchor band is secured around the head rest portion of the seat. A righthand securement strap is affixed between the strap placed over the head of the user and the anchor band. Similarly, a lefthand strap is affixed between the strap placed over the head of the user and the anchor band.

8 Claims, 2 Drawing Sheets

HEAD RESTRAINT

BACKGROUND OF THE INVENTION

The field of the invention is head restraints and the invention relates more particularly to head restraints for use when a person is seated in a chair for comfortably supporting a user's head while sleeping while traveling. A typical application would be to assist one in sleeping on an airplane.

There are numerous patents for devices for this purpose. U.S. Pat. No. 4,339,151 shows a head restraint that utilizes a strap 12 which is tightened around the back of chair 11. A headband 14 is placed around the user's forehead and either riveted to strap 12 or attached by a cord to strap 12 at a single point. The natural right and left turning of the user's head would tend to distort the headband and provide a source of discomfort.

The Meistrell U.S. Pat. No. 4,707,031 shows in FIGS. 1, 2, and 3 a head restraint which includes a seat band which is secured around the head rest portion of the seat. A band 15 is secured at the back of the band and along both sides to the securement band 19 and is wrapped around the user's forehead and secured by a "Velcro" type securement.

The Ross U.S. Pat. No. 6,301,716 shows a head support assembly for physically disabled persons and includes a headband 16 which is loosely supported to a seat back by a pair of cords 20 and 22. This device is designed to permit a substantial amount of movement of the user's head and would be inappropriate for supporting the user's head while sleeping.

U.S. Pat. No. 6,266,825 shows a traveler's head support sleeping and resting harness. As shown best in FIGS. 3 and 4, the harness has a seat harness 20 secured around the seat. An adhesive strap is secured to the seat harness and provides a head harness by a loop that passes over the user's forehead, but does not surround the user's head. The head harness is non-resilient.

In order to provide a high enough degree of comfort to permit a user to sleep, it has been found important that a limited amount of side to side head movement be possible. If too much head movement is permitted, the user's head can move into an uncomfortable position. This will cause the user to wake up. Conversely, if the user's head is fixed in a single position, this can, as time passes, cause discomfort.

BRIEF SUMMARY OF THE INVENTION

It is an object of the present invention to provide a head restraint which permits limited but elastically restrained movement of the user's head during use.

The present invention is for a head restraint for supporting a user's head with respect to the head rest portion of a seat. A headband strap is placed around the user's head across the user's forehead. The strap has a righthand securement strap attached at its first end to the head strap. Similarly, a lefthand securement strap is affixed to the left side of the head strap. Either the head strap and/or the securement straps are fabricated from an elastic material so that the user may be permitted a small degree of gentle head movement while sleeping. The securement straps have hook and eye fastener areas at their ends which may be attached to an anchor band secured over the head rest portion of the seat. The head restraint may be affixed to a child's safety or booster car seat by hook and eye fastener members adhered to the back of the child's safety or booster car seat to which the righthand and lefthand securement straps may be affixed.

DETAILED DESCRIPTION OF THE INVENTION

Figure 2:
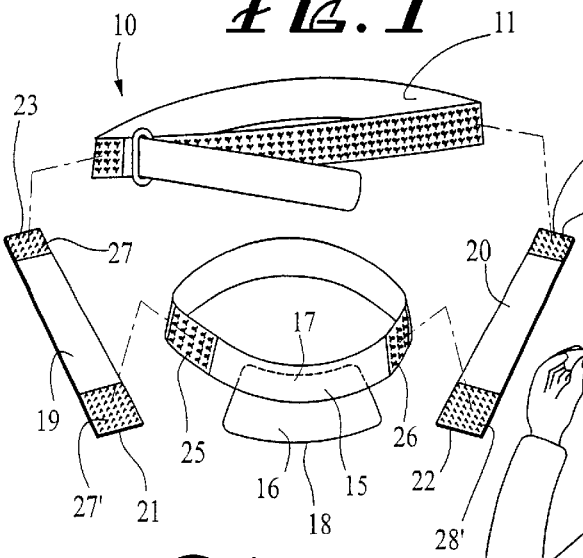
FIG. 2 is an exploded perspective view thereof.

The head restraint of the present invention is shown in exploded perspective view in FIG. 2 and indicated generally by reference character 10. Head restraint 10 has an anchor band portion 11 which is secured around the head rest area 12 of seat 13. It may be secured by the use of a buckle and/or a hook and eye fastener or simply by elasticity of the band. The user 14 has a head strap 15 placed around the user's head. Head strap 15 may be a continuous loop or may be formed by a linear length which may be made into a loop. Head strap 15 is preferably fabricated from an elastic material. It may have an eye shade portion 16, as shown in FIG. 2, secured inside the front portion 17 of head strap 15. A soft opaque material may be used for the eye shade portion 16. This soft, opaque material additionally provides a soft cushioning effect against the front of the user's forehead. One such soft opaque material is polyester fleece. The eye shade portion extends sufficiently downwardly to a bottom edge 18 which rests below the user's eyes. This material can be folded up 180° so that it rests against the front 17 of head strap 15 when not desired for use as an eye shade.

A righthand securement strap 19 and a lefthand securement strap 20 each have forward ends 21 and 22, respectively, and rearward ends 23 and 24, respectively. The forward ends 21 and 22 may be removably affixed, such as by hook and eye fasteners (of the type commonly sold under the trademark "Velcro"), to the strap 15 as indicated by hook and eye fastener portions 25 and 26 on the strap and hook and eye fasteners 27' and 28' on the forward ends. Alternatively, the straps may be permanently sewn to head strap 15.

Figure 1:
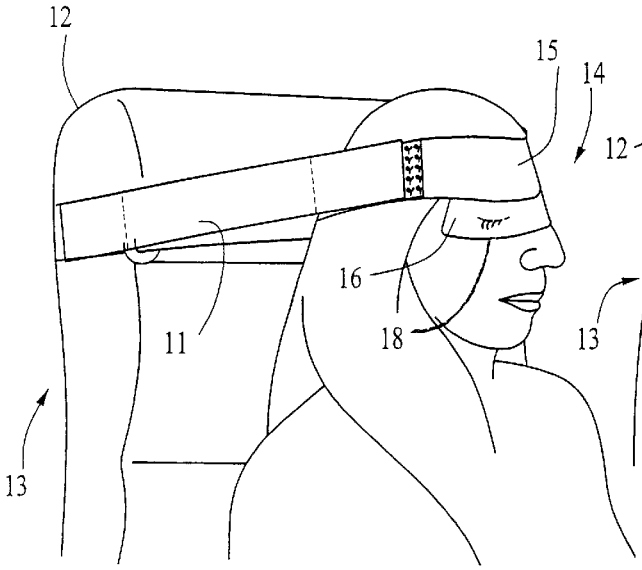
FIG. 1 is a perspective view of the head restraint of the present invention secured around a user's head and anchored to an anchor strap secured around the head rest area of a seat.
Figure 3:
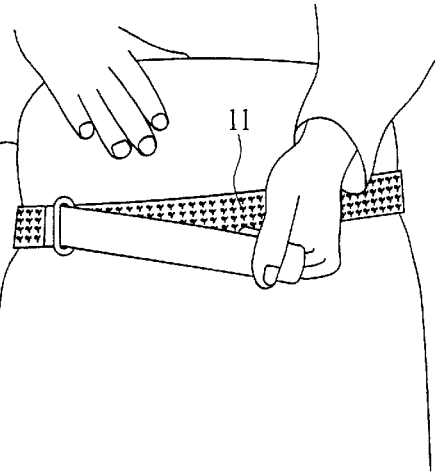
FIG. 3 is a front view showing the securing of an anchor strap around the head rest portion of a seat.
Figure 4:
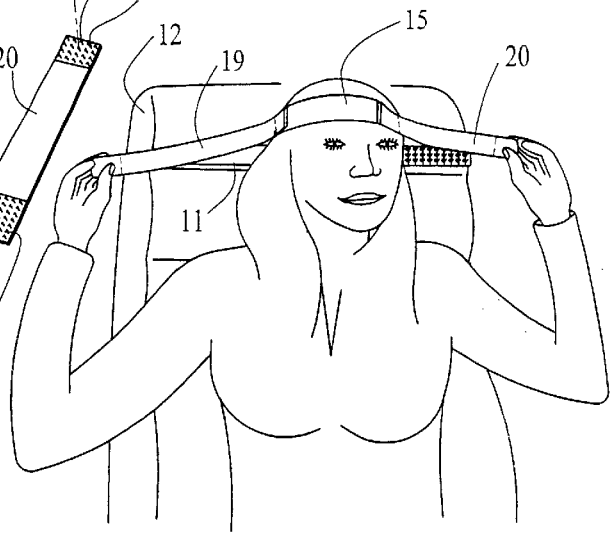
FIG. 4 is a perspective view showing the attachment of the headband of the head restraint of FIG. 1 to the anchor band.

The rearward ends 23 and 24 have hook and eye fastener areas 27 and 28. These are secured as indicated in FIG. 4, and also as shown in FIG. 1, to anchor strap 11.

Preferably, the securement straps 19 and 20 are fabricated from an elastic material. This provides some movement of the user's head and yet, prevents the user's head from moving to an uncomfortable position. This amount of movement is adjustable to the user's discretion by the amount of tension applied when affixing the securement straps.

Figure 5:
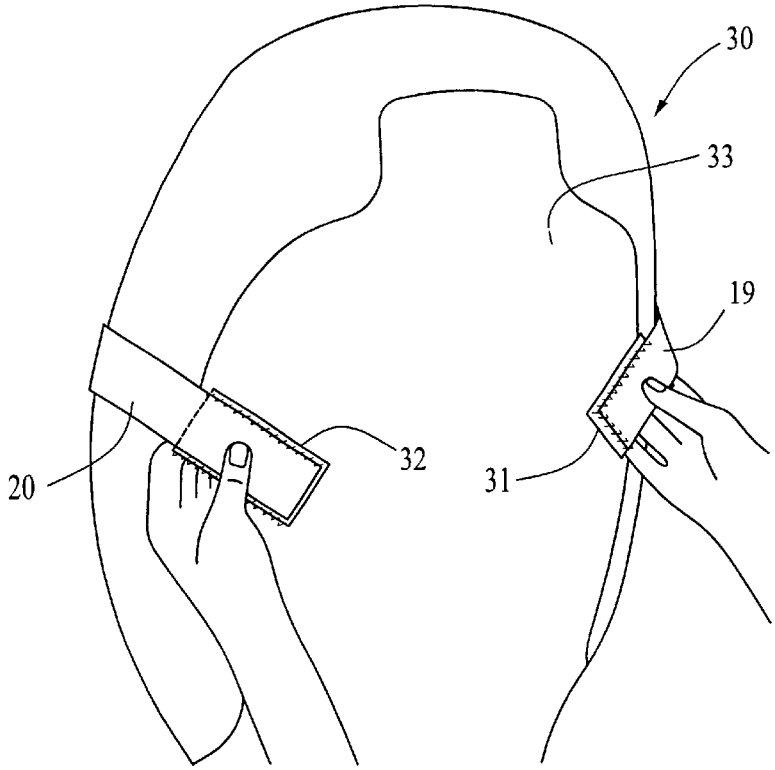
FIG. 5 is a perspective view of an alternate embodiment showing the attachment of the securement straps of FIG. 1 to the back of a child's safety or booster car seat.
Figure 6:
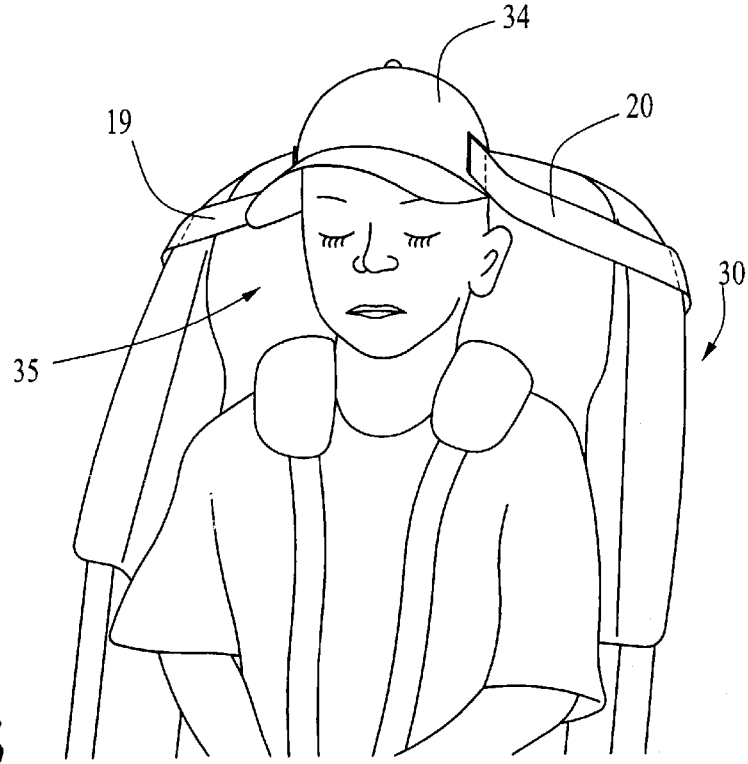
FIG. 6 is a perspective view showing the securement straps attached between a cap worn by the user and the child's safety or booster car seat of FIG. 5.

The device of the present invention can also be used in a child's safety or booster car seat, such as car seat 30 shown in FIG. 5. Hook and eye fastener pads 31 and 32 are adhered to the plastic back 33 of child's safety or booster car seat 30. These are used to affix securement straps 19 and 20 in a manner similar to that shown in FIG. 1 of the drawings.

Securement straps 19 and 20 are sewn to a cap 34 worn by user 35, although they could, of course, also be affixed by hook and eye fasteners. Since straps 19 and 20 are preferably elastic, the user has a comfortable and user adjustable amount of movement during sleeping. Typically, cap 34 has a non-elastic head band area which is typically adjustable in size.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A head restraint for supporting a user's head with respect to a headrest portion of a seat, said head restraint comprising:

an elastic strap for placing over the head of a user extendable over a users forehead, said elastic strap having a right side, a left side, and a forward portion;

an anchor band for placing over said headrest portion of a seat, said anchor band having means for tightening said anchor band around said headrest and said anchor band having a hook and eye fastener attachment area on a right side of said anchor band and on a left side of said band;

a right hand securement strap having a first end attached to the right side of said elastic strap and a second end and having a mating hook and eye fastener area on an inner surface of said securement strap which hook and eye fastener area mates the second end with said hook and eye fastener attachment area on said right side of said anchor band; and a left hand securement strap having a first end attached to the left side of said elastic strap and a second end and having a mating hook and eye fastener area on an inner surface of said securement strap which hook and eye fastener area mates the second end with said hook and eye fastener attachment area on said left side of said anchor band.

2. The head restraint of claim 1 wherein at least one of said right hand and left hand securement straps is fabricated from an elastic material.

3. The head restraint of claim 2 wherein both of said right hand and left hand securement straps are fabricated from an elastic material.

4. The head restraint of claim 1 further including an eyeshade affixed to the forward portion, said eyeshade comprising:

a strip of opaque material fabricated from a soft cushioning fabric having a top edge affixed to an inner surface of said forward portion of said head strap at a top edge of the head strap, a right side, a left side, and a bottom edge, said bottom edge being positioned sufficiently below said elastic strap so that when it is in an unfolded configuration it extends below a user's eyes, said opaque material thus acting not only as an eyeshade but also as a cushioning comfort pad.

5. A head restraint for supporting a user's head with respect to a headrest portion of a seat, said head restraint comprising:

a head strap for placing over the head of a user extendable over a users forehead, said head strap having a right side and a left side of said head strap;

an anchor band for placing over said headrest, said anchor band having means for tightening said anchor band around said headrest and said anchor band having a hook and eye fastener attachment area on a right side of said anchor band and on a left side of said anchor band;

a right hand securement strap having a first end attached to the right side of said head strap and a second end and having a mating hook and eye fastener area on an inner surface of said securement strap which hook and eye fastener area mates the second end with said hook and eye fastener attachment area on said right side of said anchor band and said right hand securement strap being fabricated from an elastic material; and a left hand securement strap having a first end attached to the left side of said head strap and a second end and having a mating hook and eye fastener area on an inner surface of said securement strap which hook and eye fastener area mates the second end with said hook and eye fastener attachment area on said left side of said anchor band and said left hand securement strap being fabricated from an elastic material.

6. A process for supporting a user's head with respect to a headrest portion of a seat comprising:

encircling the headrest portion of the seat with an anchor band and securing said anchor band to said headrest portion of the seat at a vertical height near the eye level of the user when the user is seated in the seat, said anchor band having a hook and eye fastener area exposed on at least a right hand portion and a left hand portion thereof;

sitting in the seat;

sliding an elastic headband over the user's head to a position over the user's forehead, said headband having a right elastic securement strap affixed to a right side thereof and a left elastic securement strap affixed to a left side thereof;

affixing the right elastic securement strap to the right hand portion of said anchor band; and affixing the left elastic securement strap to the left hand portion of said anchor band.

7. A head restraint for supporting a user's head with respect to a headrest portion of a child's safety or booster car seat, said head restraint comprising:

a head strap for placing over the head of a user extendable over a users forehead, said head strap having a right side and a left side;

a right and a left hook and loop fastener area on a right side and left side of a back of said car seat;

a right hand securement strap having a first end attached to the right side of said head strap and a second end and having a mating hook and eye fastener area on an inner surface of said securement strap which hook and eye fastener area mates the second end with said hook and eye fastener attachment area on said right side of said back of said car seat and said right hand securement strap being fabricated from an elastic material; and a left hand securement strap having a first end attached to the left side of said head strap and a second end and having a mating hook and eye fastener area on an inner surface of said securement strap which hook and eye fastener area mates the second end with said hook and eye fastener attachment area on said left side of said back of said car seat and said left hand securement strap being fabricated from an elastic material.

8. The head restraint of claim 7 wherein said head strap is a lower portion of a cap.

* * * * *